US009167369B2

(12) United States Patent
Takumai et al.

(10) Patent No.: US 9,167,369 B2
(45) Date of Patent: Oct. 20, 2015

(54) SPEAKER ARRAY APPARATUS

(75) Inventors: Susumu Takumai, Hamamatsu (JP); Kenichiro Takeshita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 93 days.

(21) Appl. No.: 14/129,180

(22) PCT Filed: Jun. 29, 2012

(86) PCT No.: PCT/JP2012/066809

§ 371 (c)(1),
(2), (4) Date: Dec. 24, 2013

(87) PCT Pub. No.: WO2013/002401

PCT Pub. Date: Jan. 3, 2013

(65) Prior Publication Data

US 2014/0126753 A1 May 8, 2014

(30) Foreign Application Priority Data

Jun. 30, 2011 (JP) ..... 2011-146720

(51) Int. Cl.

| | |
|---|---|
| ***H04S 7/00*** | (2006.01) |
| ***H04R 1/40*** | (2006.01) |
| ***H04R 5/02*** | (2006.01) |

(52) U.S. Cl.

CPC ..... *H04S 7/305* (2013.01); *H04R 1/403* (2013.01); *H04R 5/02* (2013.01); *H04R 2201/401* (2013.01); *H04R 2203/12* (2013.01)

(58) Field of Classification Search

CPC .. H04R 2499/15; H04R 3/12; H04R 2499/11; H04R 1/028; H04R 5/02; H04R 27/00

USPC ..... 381/303

See application file for complete search history.

(56) References Cited

U.S. PATENT DOCUMENTS 5,953,432 A 9/1999 Yanagawa et al.
8,675,899 B2 * 3/2014 Jung ..... 381/307

(Continued)

FOREIGN PATENT DOCUMENTS

CN 1883228 A 12/2006
CN 101288338 A 10/2008

(Continued)

OTHER PUBLICATIONS

International Search Report dated Jul. 31, 2012 w/ English translation (two (2) pages).

(Continued)

*Primary Examiner* — Mark Blouin
(74) *Attorney, Agent, or Firm* — Crowell & Moring LLP

(57) ABSTRACT

A speaker array device includes a first speaker array and a second speaker array. The first speaker array has plural first speaker units arranged in a first surface and output a first sound. The second speaker array has plural second speaker units arranged in a second surface that is different from the first surface and output a second sound. When the second speaker array and the first speaker array are installed in a room having a ceiling, the second speaker array is installed in such a manner that a normal direction to the second surface is match with a direction in which the second sound emitted from the second speaker array reaches, only indirectly, through reflection or diffraction, a sound receiving point or that the normal direction to the second surface is match with a direction in which the second sound reaches the sound receiving point with a predetermined sound volume.

5 Claims, 15 Drawing Sheets

(56) References Cited

U.S. PATENT DOCUMENTS

| | | | | |
|---|---|---|---|---|
| 8,705,757 | B1 * | 4/2014 | Betbeder | 381/63 |
| 8,737,634 | B2 * | 5/2014 | Brown et al. | 381/71.11 |
| 8,737,674 | B2 * | 5/2014 | Dehe | 381/395 |
| 8,879,741 | B2 * | 11/2014 | Fukuyama | 381/17 |
| 8,971,547 | B2 * | 3/2015 | Button | 381/92 |
| 8,995,697 | B2 * | 3/2015 | Gladwin et al. | 381/304 |
| 2005/0244010 | A1 | 11/2005 | Kuwahara et al. | |
| 2006/0126878 | A1 | 6/2006 | Takumai et al. | |
| 2007/0019831 | A1 | 1/2007 | Usui | |
| 2007/0110268 | A1 | 5/2007 | Konagai et al. | |
| 2009/0028358 | A1 | 1/2009 | Suzuki | |
| 2009/0129602 | A1 | 5/2009 | Konagai et al. | |

FOREIGN PATENT DOCUMENTS

| | | | |
|---|---|---|---|
| EP | 1 631 118 | A1 | 3/2006 |
| EP | 1 662 842 | A1 | 5/2006 |
| JP | 6-205496 | A | 7/1994 |
| JP | 2004-363695 | A | 12/2004 |
| JP | 2005-64746 | A | 3/2005 |
| JP | 2005-287002 | A | 10/2005 |
| JP | 2007-37058 | A | 2/2007 |
| JP | 2009-27603 | A | 2/2009 |

OTHER PUBLICATIONS

Japanese-language Written Opinion (PCT/ISA/237) dated Jul. 31, 2012 (four (4) pages).

Chinese Office Action dated Mar. 19, 2015 with English translation (12 pages).

European Search Report dated Apr. 15, 2015 (Seven (7) pages).

* cited by examiner

SPEAKER ARRAY APPARATUS

TECHNICAL FIELD

The present invention relates to a technique of causing a sound to reach a sound receiving point by reflecting it using a speaker array.

BACKGROUND ART

A method is known in which surround-channel sounds are caused to reach a sound receiving point by having them reflected by wall surfaces utilizing a phenomenon that a sound that is output from a speaker array in which plural speaker units arranged regularly exhibits beam-like directivity. For example, Patent document 1 discloses a technique of causing left and right surround-channel sounds emitted from a speaker array installed right in front of a sound receiving point to reach the sound receiving point by having reflected by wall surfaces. With this technique, virtual speakers are formed in directions of wall surfaces that are located on the left and right of a sound receiving point.

PRIOR ART DOCUMENTS

Patent Documents

Patent document 1: JP-A-2004-363695
Patent document 2: JP-A-2009-027603

SUMMARY OF THE INVENTION

Problems to be Solved by the Invention

Incidentally, with the recent increase in the sizes of TV receivers, listeners have increasingly come to feel uncomfortable because of a large distance between the installation position of a speaker array device for outputting a TV sound and the display position of an image representing a sound source on the TV screen. Where these positions are distant from each other in the horizontal direction, the degree of such an uncomfortable feeling can be reduced by forming virtual speakers in directions of wall surfaces located on the left and right of a listener using a speaker array as mentioned above. Where these positions are distant from each other in the vertical direction and, for example, the display position of an image representing a sound source is higher than the position of a speaker array device in the vertical direction, the degree of such an uncomfortable feeling can be reduced by forming a virtual speaker in a direction of a ceiling as viewed from a listener. A method for realizing a virtual speaker in a direction of a ceiling in known which employs speaker units arranged in the vertical direction. However, with only a single column of speaker units arranged in the vertical direction, the directivity angle of an output sound cannot be controlled in the horizontal direction and hence it is difficult to express a difference between positions where left and right surround-channel virtual speakers are formed. To express such a difference, it is necessary to arrange plural speaker units not only in the vertical direction but also in the horizontal direction, that is, to construct what is called a panel-type two-dimensional speaker array. In this case, however, the speaker array device is increased in size and requires a wide installation space.

The present invention has been made in the above circumstances, and one object of the invention is to realize a small speaker array device which forms plural virtual speakers in each of the horizontal direction and the vertical direction.

Means for Solving the Problems

To solve the above problems, the invention provides a speaker array device comprising: a first speaker array y configured to have plural first speaker units arranged in a first surface and output a first sound that is directed to a particular first directivity direction from the plural first speaker units such that an angle of the first directivity direction with respect to an arrangement direction of the plural first speaker units is adjustable; and a second speaker array configured to have plural second speaker units arranged in a second surface that is different from the first surface and output a second sound that is directed to a particular second directivity direction from the plural second speaker units such that an angle of the second directivity direction with respect to an arrangement direction of the plural second speaker units is adjustable, wherein when the second speaker array is installed together with the first speaker array in a room having a ceiling which functions as a sound reflection surface, the second speaker array is installed in such a manner that a normal direction to the second surface is match with a direction in which the second sound emitted from the second speaker array reaches, only indirectly, through reflection or diffraction, a sound receiving point or a direction in which the second sound reaches the sound receiving point with such a sound volume that a ratio of a sound pressure of the second sound that reaches the sound receiving point after being reflected by the ceiling to a sound pressure of the second sound that reaches the sound receiving point directly is larger than or equal to a prescribed value, the sound receiving point being located in a normal direction to the first surface and being set as a position for listening to the first sound.

In one illustrative mode, the second speaker array outputs the second sound based on an audio signal supplied to the second speaker array, the speaker array device is configured to further have a delay section which delays the audio signal according a difference between a length of a path of the second sound from the second speaker array to the sound receiving point and a length of a path of the first sound from the first speaker array to the sound receiving point, and the first speaker array outputs the first sound based on a delayed audio signal generated by the delay section.

In another illustrative mode, the speaker array device further comprises an attenuator configured to attenuate a component of the audio signal in part, lower than or equal to a prescribed boundary frequency, of a frequency range of a sound represented by the audio signal, the second speaker array outputs the second sound based on an attenuated audio signal generated by the attenuator, and the first speaker array outputs the first sound based on an audio signal, not attenuated by the attenuator, of the component of the audio signal in part, lower than or equal to the prescribed boundary frequency, of the frequency range of the sound represented by the audio signal.

In still another illustrative mode, the speaker array device further comprises: a determining section configured to determine a direction to form a virtual image for the sound receiving point using the first sound and the second sound, and an adjustor configured to adjust respective volumes of the first sound and the second sound, the boundary frequency, or a time by which the delay section delays the audio signal, according to the direction determined by the determining section, the first speaker array outputs the first sound based on an audio signal generated by processing that uses a result of the adjustment by the adjustor, and the second speaker array outputs the second sound based on an audio signal generated by processing that uses a result of the adjustment by the adjustor.

In a further illustrative mode, all of vibration plates of the plural second speaker units are disposed at such positions as not to be seen from the sound receiving point when the second speaker array is installed in the room.

Advantageous Effects of the Invention

The invention can realize a small speaker array device which can form plural virtual speakers in each of the horizontal direction and the ceiling direction unlike in a case that the at least two speaker arrays are not installed in the manner of the above-described configuration.

MODE FOR CARRYING OUT THE INVENTION

An embodiment of the present invention will be hereinafter described with reference to the drawings.

Figure 1:
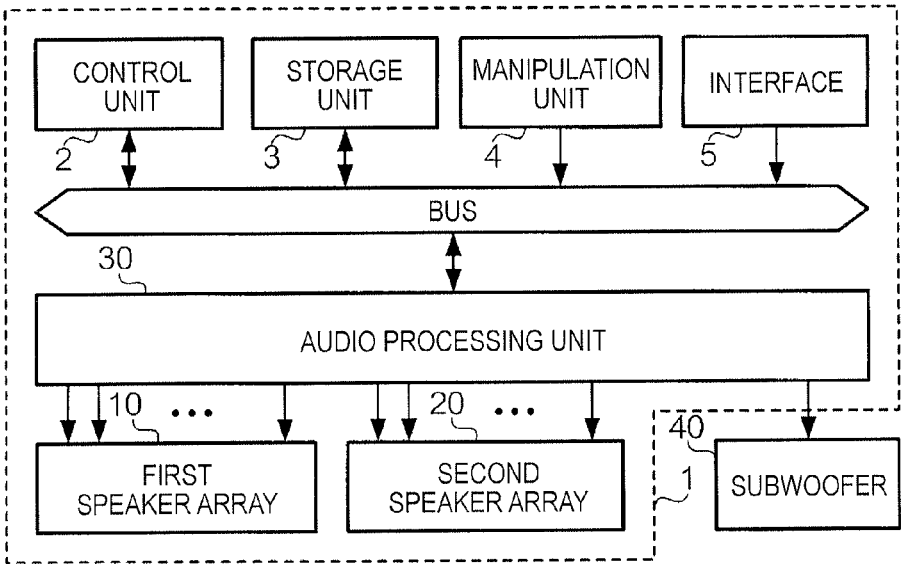
FIG. 1 is a block diagram showing the configuration of a speaker array device according to an embodiment.

FIG. 1 is a block diagram showing the configuration of a speaker array device 1. The speaker array device 1 is equipped with a control unit 2, a storage unit 3, a manipulation unit 4, an interface 5, and an audio processing unit 30 which are connected to each other by a bus, as well as a first speaker array 10 and a second speaker array 20 which are connected to the audio processing unit 30. The speaker array device 1 is a device for outputting sounds that are directed to particular directions from the first speaker array 10 and the second speaker array 20 by processing audio signals with the audio processing unit 30. A sound that is directed to a particular direction will be referred to as a sound beam.

The control unit 2 has a CPU (central processing unit), a RAM (random access memory), a ROM (read-only memory), etc. The control unit 2 controls the individual units of the speaker array device 1 via the bus by running programs that are stored in the storage unit 3 or the ROM. For example, the control unit 2 also functions as a setting section for, for example, setting parameters used in each kind of processing performed by the audio processing unit 30 by controlling the audio processing unit 30.

The storage unit 3 is a storage such as a nonvolatile memory, and stores, among other things, setting parameters that are used by the CPU 2 in controlling the individual units. The setting parameters include parameters indicating volumes of sound beams and parameters that are set by the control unit 2 according to output directions of sound beams, respectively, and used by the audio processing unit 30.

The manipulation unit 4 has a manipulator such as a volume level adjustment knob and manipulation buttons for input of a setting change instruction, and outputs information indicating a manipulation content to the control unit 2.

The interface 5 includes, among other things, an input terminal for acquiring audio signals Sin from the outside.

Each of the first speaker array 10 and the second speaker array 20 has plural speaker units, and outputs sounds that are directed to a particular direction by causing those sounds to be output from the speaker units on the basis of respective audio signals that are input from the audio processing unit 30.

A subwoofer 40 outputs a sound in a low-frequency range.

The audio processing unit 30 processes audio signals Sin acquired via the interface 5, and generates audio signals based on which the first speaker array 10, the second speaker array 20, and the subwoofer 40 output sounds, respectively. The audio processing unit 30 supplies the generated audio sounds to the first speaker array 10, the second speaker array 20, and the subwoofer 40, respectively.

Figure 2:
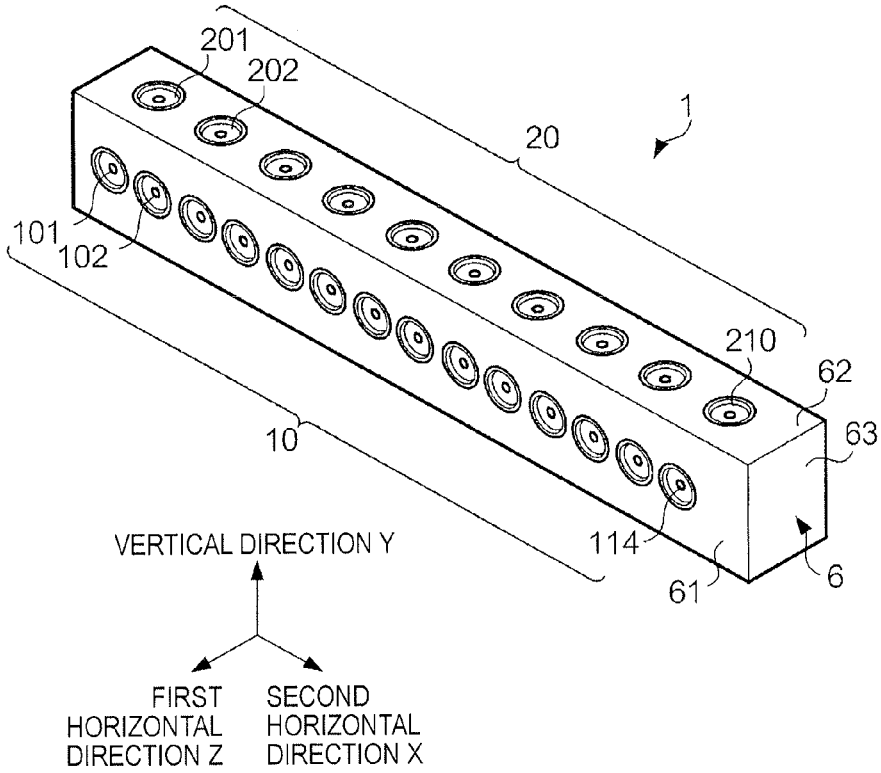
FIG. 2 shows an appearance of the speaker array device.

FIG. 2 shows an appearance of the speaker array device 1. FIG. 2 shows a state that the speaker array device 1 is installed on a horizontal floor surface. The speaker array device 1 has a hollow cabinet 6 which is provided with the first speaker array 10 and the second speaker array 20. The cabinet 6 is shaped like a prism having six surfaces including rectangular surfaces 61 and 62 and a trapezoidal surface 63 that are adjacent to each other. The surface 61 is provided with the first speaker array 10, and the surface 62 is provided with the second speaker array 20. The surface 61 is a surface that extends in the vertical direction Y and is directed to a listener when the speaker array device 1 is installed. That is, the surface 61 is a front surface of the speaker array device 1. In the following description, the direction to the surface 61 is directed, that is, the direction along the normal to the surface 61, will be referred to as a first horizontal direction Z. The first horizontal direction Z is a direction that is perpendicular to the vertical direction Y. The surface 62 is a surface that is directed to the ceiling when the speaker array device 1 is installed in a room. The surface 63 is a side surface when the cabinet 6 is seen from the front side (i.e., the side of the surface 61).

The first speaker array 10 has 14 speaker units (first speaker units 101 to 114). In the following description, these plural speaker units will be referred to as "first speaker units 100" when they are not discriminated from each other. The first speaker units 100 are arranged in the surface 61 (first surface) in a row that extends in a second horizontal direction X which is perpendicular to the vertical direction Y and the first horizontal direction Z. The second horizontal direction X is a horizontal direction that is parallel with the surface 61. That is, the first speaker units 100 are arranged in such a manner that the longitudinal direction (referred to as a longitudinal direction of the first speaker array 10) of a shape (in this case, a straight line) formed by the arrangement is parallel with the second horizontal direction X. The term "arranged in the surface 61" as used herein means that the first speaker units 100 are disposed in such a manner that the wider-radius ends of their vibration plates are located in the plane containing the surface 61. The first speaker units 100 are arranged so that all of the principal axes of sounds that are output from them are parallel with a particular direction (first principal axis direction). The surface 61 is formed with 14 holes that are arranged in the second horizontal direction X, and the first speaker units 100 are exposed through the respective holes. The first speaker array 10 outputs, from the first speaker units 100, a sound beam (first sound) that is directed to a particular direction (first directivity direction) and is such that the angle formed by the first directivity direction and the second horizontal direction X is adjustable.

Figure 3:
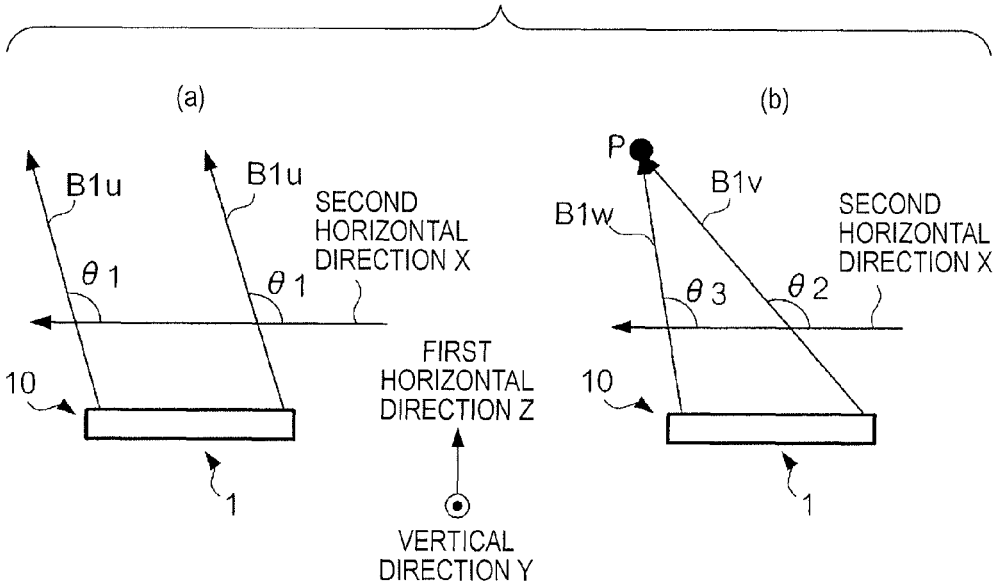
FIGS. 3(*a*) and 3(*b*) show an example of the angle formed by a first directivity direction of a surround beam and a second horizontal direction which is the arrangement direction of a first speaker array.

FIGS. 3(*a*) and 3(*b*) show an example of the angle formed by the first directivity direction of a surround beam B1 and the second horizontal direction X which is the arrangement direction of the first speaker array 10. FIGS. 3(*a*) and 3(*b*) show a direction in which a sound beam B1 that is output from the first speaker array 10 travels, that is, the first directivity direction, in a state that the speaker array device 1 is seen along the vertical direction Y from the side of the second speaker array 20. FIG. 3(*a*) shows a case that the sound beam B1 is a parallel beam whose wavefront (a simplified term "wavefront" is used here though it is strictly an envelope of the wavefronts of sounds emitted from the respective speakers) assumes a flat plane. Arrows B1*u* in this figure indicate example paths along which the wavefront of the sound beam B1 travels. In this case, as indicated by arrows B1*u*, at any position, the wavefront of the sound beam B1 travels in a direction that forms an angle θ1 with the second horizontal direction X. FIG. 3(*b*) shows a case that the sound beam B1 is a convergent beam whose wavefront assumes a cylindrical plane. In this case, at any position, the wavefront of the sound beam B1 travels in a direction toward a converging point P. Arrows B1*v* and B1*w* in this figure indicate example paths along which the wavefront of the sound beam B1 travels. For example, as for a portion, traveling along the path indicated by arrow B1*v*, of the sound beam B1, the wavefront of that portion travels in a direction that forms an angle θ2 with the second horizontal direction X. As for another portion, traveling along the path indicated by arrow B1*w*, of the sound beam B1, the wavefront of that portion travels in a direction that forms an angle θ3 with the second horizontal direction X. In either case, the first speaker array 10 can adjust the angle(s) (θ1, θ2, θ3).

The second speaker array 20 has 10 speaker units (second speaker units 201-210). In the following description, these plural speaker units will be referred to as "second speaker units 200" when they are not discriminated from each other. The second speaker units 200 are arranged in the surface 62 in a row that extends in the second horizontal direction X. The second horizontal direction X is a horizontal direction that is parallel with the surface 61. In other words, the second speaker units 200 are arranged in such a manner that the longitudinal direction (referred to as a longitudinal direction of the second speaker array 20) of a shape (in this case, a straight line) formed by the arrangement is parallel with the second horizontal direction X. The second speaker units 200 are arranged so that all of the principal axes of sounds that are output from them are parallel with a particular direction (second principal axis direction) which is different from the first principal axis direction. As described later, the second speaker array 20 is a speaker array for forming a virtual speaker on the ceiling side. In many cases, a sound to form a virtual speaker on the ceiling side as viewed from a listener may have a smaller sound volume than on the front side, left side, or the right side of a listener. Therefore, the second speaker units 200 are smaller than the first speaker units 100 in size and number. The second speaker array 20 outputs, from the second speaker units 200, a sound beam (second sound) that is directed to a particular direction (second directivity direction) and is such that the angle formed by the second directivity direction and the second horizontal direction X (longitudinal direction of the second speaker array 20) is adjustable.

Next, how the individual speaker units are disposed in the cabinet 6 in a cross section taken perpendicularly to the second horizontal direction X will be described with reference to FIG. 4.

Figure 4:
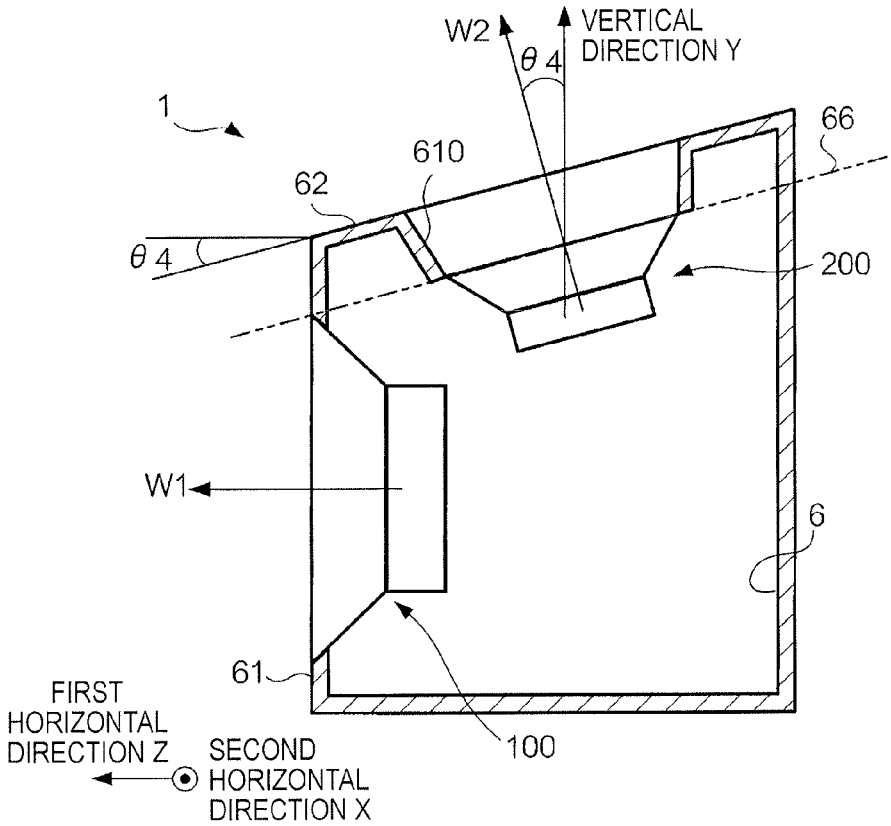
FIG. 4 is a sectional view of the speaker array device taken perpendicularly to the second horizontal direction.

FIG. 4 is a sectional view of the cabinet 6 taken perpendicularly to the second horizontal direction X. FIG. 4 is a sectional view obtained by cutting the cabinet 6 at a position where a second speaker unit 200 is disposed. In FIG. 4, to simplify the description, side views, rather than sectional views, of speaker units are drawn. Each first speaker unit 100 has a vibration plate and is disposed in such a manner that the wider-radius end of its vibration plate is located in the plane containing the surface 61. In other words, each first speaker unit 100 is disposed so that its vibration plate vibrates in the direction to which the surface 61 is directed. This direction is the same as the above-mentioned first principal axis direction W1 and the front direction of the first speaker units 100. The first principal axis direction W1 is parallel with the normal direction of the surface 61, that is, the first horizontal direction Z.

Each second speaker unit 200 has a vibration plate and is disposed in a recess portion 610 that is formed by recessing the surface 62 inward and has a bottom opening. Therefore, in each second speaker unit 200, the wider-radius end of its vibration plate is spaced inward from the surface 62, that is, located inside the cabinet 6. That is, the second speaker units 200 are arranged in a plane 66 (indicated by a two-dot chain line in FIG. 4) which contains the bottoms of the recess portions 610. The plane 66 is different from the surface 61 (first surface) and corresponds to an example of a "second surface" as defined in the invention. The plane 66 is parallel with the surface 62. Each second speaker unit 200 is disposed so that its vibration plate vibrates in the direction that is parallel with the normal to the surface 62. This direction in the direction that is parallel with the normal to the plane 66 and is the same as the above-mentioned second principal axis direction W2 and the front direction of the second speaker units 200. The surface 62 is inclined from the first horizontal direction Z by an angle θ4 (in this example, 15°). Therefore, the second principal axis direction W2 is also inclined from the vertical direction Y by θ4 (15°) toward the first horizontal direction Z.

In the speaker array device 1, so that sound beams and a sound (subwoofer sound) that is output from the subwoofer 40 that are based on same-timing portions of audio signals reach a sound receiving point approximately at the same time, they are output at different time points. The sound receiving point means a predetermined position where a listener is to listen to a sound that is output from the speaker array device 1, in other words, a position that is assumed as a listening position of a listener. The sound receiving point is set at a position that is spaced from both speaker arrays by more than a certain distance because if it is too close to one speaker array it becomes difficult for a listener to hear a sound coming from the other speaker array. More specifically, for example, the sound receiving point is set at a position that is spaced from the first speaker array 10 by 1 m or more in the normal direction of the surface 61 (the same direction as the first principal axis direction W1) and lower than the height of humans. In other words, when the sound receiving point is set at such a position, a listener can hear, with high quality, a sound that is output from the speaker array device 1. Various settings are made in the speaker array device 1 so that it outputs sound beams that produce optimum sounds at the sound receiving point. Stated in more detail, in the speaker array device 1, the output time points of individual sounds are delayed according to differences between distances the respective sounds travel until reaching the sound receiving point. An example difference between distances is a difference between the length of a path to the sound receiving point taken by a sound beam that is output from the first speaker array 10 and the length of a path to the sound receiving point taken by a sound beam that is output from the second speaker array 20.

If a change occurs in the environment that includes the room where the speaker array device 1 is installed, the position where the speaker array device 1 is installed in the room, the position of the sound receiving point, and other factors, the times by which to delay respective sound beams vary accordingly. Therefore, when such an environmental change has occurred, the control unit 2 of the speaker array device 1 stores times (hereinafter referred to as delay times) by which to delay respective sounds so that they reach the sound receiving point approximately at the same time and output directions of those sounds in the storage unit 3 in such a manner that the delay times and the output directions are correlated with each other. The delay times and the output directions are determined in the following manner. First, the speaker array device 1 installed in a room is caused to output a sound beam, and sounds picked up by a microphone disposed at a position (hereinafter referred to as a measurement position) that is assumed to be the sound receiving point in advance are recorded while the output direction is scanned. Subsequently, based on the measurement results, a direction in which to output a sound of each channel is selected (and set) as a sound beam output direction from, for example, directions in each of which the picked up sound volume is larger than in neighboring output directions. Times by which to delay respective sound beams are calculated from times taken to reach the measurement position by respective sound beams that are output in the thus-set output directions. The setting of output directions and the calculation of delay times may be done using a known technique as disclosed in Patent document 2. The audio processing unit 30 processes audio signals according to the calculated delay times, whereby sound beams and a subwoofer sound are output so that they reach the sound receiving point approximately at the same time.

Figure 5:
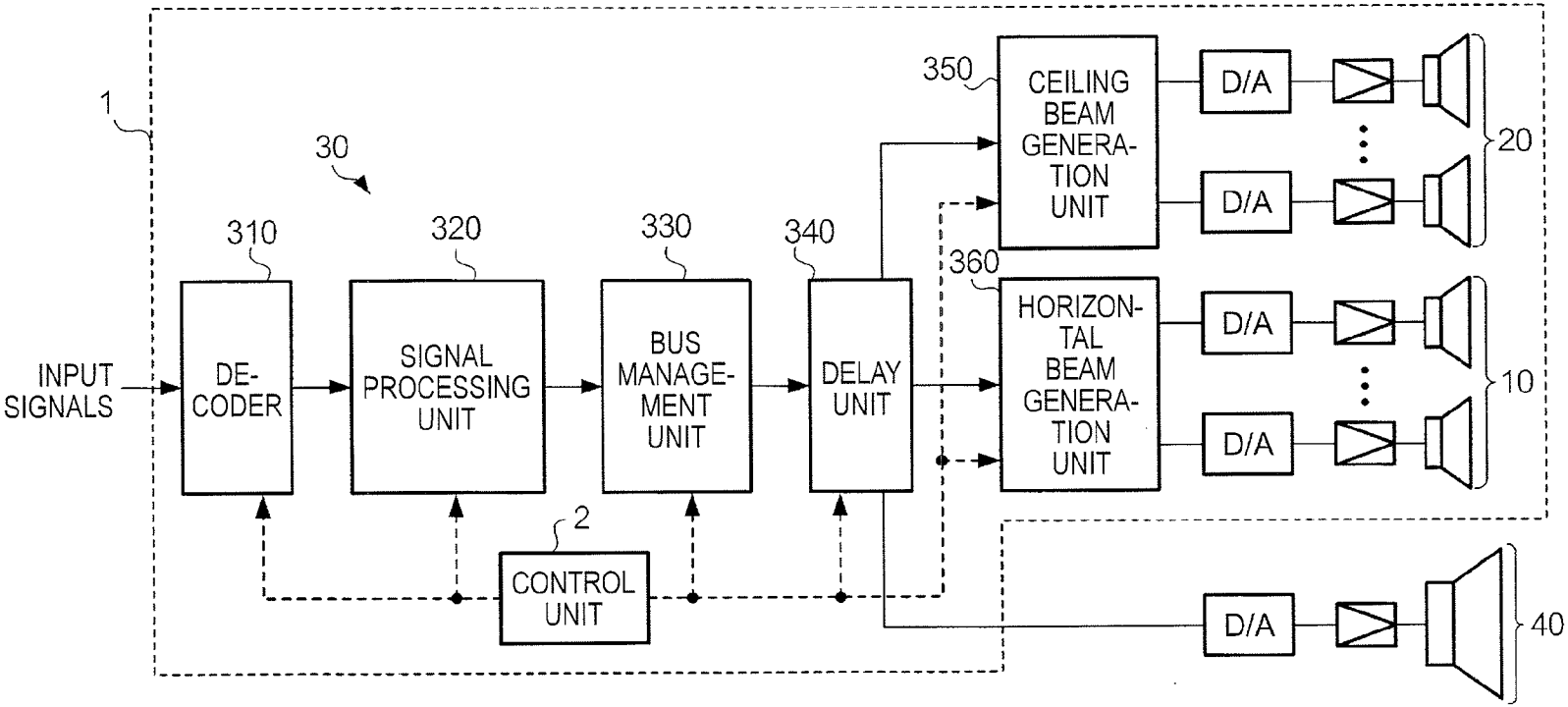
FIG. 5 is a block diagram showing the functional configuration of an audio processing unit.

FIG. 5 is a block diagram showing the functional configuration of the audio processing unit 30. The audio processing unit 30 has a decoder 310, a signal processing unit 320, a bus management unit 330, a delay unit 340, and a ceiling beam generation unit 350, and a horizontal beam generation unit 360.

The decoder 310 decodes input signals Sin which are input from the interface 5. It is assumed that the input signals Sin represent 5.1ch audio signals. The decoder 310 supplies the signal processing unit 320 with 5.1ch audio signals obtained by decoding the input signals Sin.

The signal processing unit 320 supplies the bus management unit 330 with extended signals obtained by adding, to the received 5.1ch audio signals, signals newly generated through addition or separation of reverberations or effect sound addition. The signal processing unit 320 newly generates 3-channel extended signals from 5-channel extended signals that include reverberations or have been subjected to effect sound addition among the above extended signals and employs them as signals (hereinafter referred to as ceiling signals) to be used by the second speaker array 20. More specifically, the signal processing unit 320 employs, for one channel (ceiling-L channel), a signal L'+SL' obtained by adding extended signals L' and SL' generated from channel signals L and SL among the 5-channel extended signals. The signal processing unit 320 also employs, for another channel (ceiling-R channel) signal, a signal R'+SR' obtained by adding extended signals R' and SR' generated from channel signals R and SR. A channel C subjected to attenuation (described above) is called a ceiling-C channel. In this manner, the signal processing unit 320 supplies ceiling signals having the three channels ceiling-L, ceiling-R, and ceiling-C to the bus management unit 330.

The signal processing unit 320 supplies the received 5.1ch audio signals themselves or signals obtained by subtracting reverberation components from the received 5.1ch audio signals to the bus management unit 330 as signals (hereinafter referred to as horizontal signals) to be used by the first speaker array 10. As a result, the first speaker array 10 outputs a sound beam (first sound) on the basis of those audio signals.

Where the same audio signals are to be reproduced by the first speaker array 10 and the second speaker array 20, the signal processing unit 320 decreases the sound volume of a sound represented by the other signals according to the sound volume of a sound represented by one signals. For example, if ceiling signals represent a sound having a sound volume that is 70% of the sound volume of a sound represented by decoded audio signals, the sound volume of a sound represented by horizontal signals is set to 30%. If ceiling signals represent a sound having a sound volume that is 10% of the sound volume of a sound represented by decoded audio signals, the sound volume of a sound represented by horizontal signals is set to 90%. This sound volume balancing performed by the signal processing unit 320 makes it possible to set an orientation position at a halfway position between orientation positions of the two speaker arrays while a sense of sound volume of the original audio signals is maintained.

The bus management unit 330 separates a low-frequency-range audio signal (hereinafter referred to as a subwoofer signal) including a subwoofer LFE (low frequency effect)-channel signal from the received audio signals. As a result, the audio signals are separated into the signals (hereinafter referred to as front signals) for the first speaker array 10, the ceiling signals, and the subwoofer signal. Furthermore, the bus management unit 330 performs processing of attenuating the ceiling signals in a part, lower than a predetermined frequency (what is called a cutoff frequency), of the frequency range of the ceiling signals. As a result, a sound beam (second sound) is output from the second speaker array 20 on the basis of the thus-attenuated audio signals. The bus management unit 330 functions as an "attenuator" as defined in the invention. The bus management unit 330 supplies the above audio signals to the delay unit 340.

The delay unit 340 (delay section) delays the audio signals of the respective channels contained in the received front signals, ceiling signals, and subwoofer signal according to the above-described differences between the distances sound signals and a subwoofer sound that are output on the basis of those signals travel until reaching the sound receiving point. More specifically, first, the control unit 2 supplies the delay unit 340 with the above-described delay times which are stored in the storage unit 3 so as to be correlated with the respective output directions. The delay unit 340 delays the signals by the delay times which are correlated with the respective output directions of the audio signals of the individual channels. Since these delay times are not for directivity control, a common delay time is applied to the plural speaker units of each speaker array. The delay unit 340 supplies the delayed ceiling signals and front signals to the ceiling beam generation unit 350 and the horizontal beam generation unit 360, respectively. And the delay unit 340 supplies the delayed subwoofer signal to a D/A converter that is connected to the subwoofer 40.

The ceiling beam generation unit 350 delays the audio signals of the channels which are contained in the received ceiling signals according to the output directions, respectively. The delay times are times that are determined according to the respective output directions for each second speaker unit 200. The ceiling beam generation unit 350 adds together the delayed audio signals of the respective channels and outputs a resulting signal to each second speaker unit 200. In this manner, the ceiling beam generation unit 350 controls the directivity of sounds represented by the ceiling signals supplied from the delay unit 340.

The audio signals that are output from the ceiling beam generation unit 350 are D/A-converted by D/A converters, amplified by amplifiers, and output from the second speaker units 200 as sound beams. In this manner, sound beams of sounds relating to the channels ceiling-L, ceiling-R, and ceiling C are output from the second speaker array 20 so as to be directed to the respective set directions. These sound beams are sounds in a frequency range that is higher than a prescribed frequency because they are output on the basis of the above-described ceiling signals.

The horizontal beam generation unit 360 performs processing that is similar to the processing performed by the ceiling beam generation unit 350, whereby sound beams of sounds relating to the channels ceiling-L, ceiling-R, and ceiling C are output from the first speaker array 10 so as to be directed to the respective set directions.

Next, a description will be made of how a sound beam that is output from the second speaker array 20 reaches the sound receiving point in a case that the second speaker array 20 and the first speaker array 10 (i.e., speaker array device 1) are installed and used in a room that has, as a reflection surface, a ceiling having a prescribed height.

Figure 6:
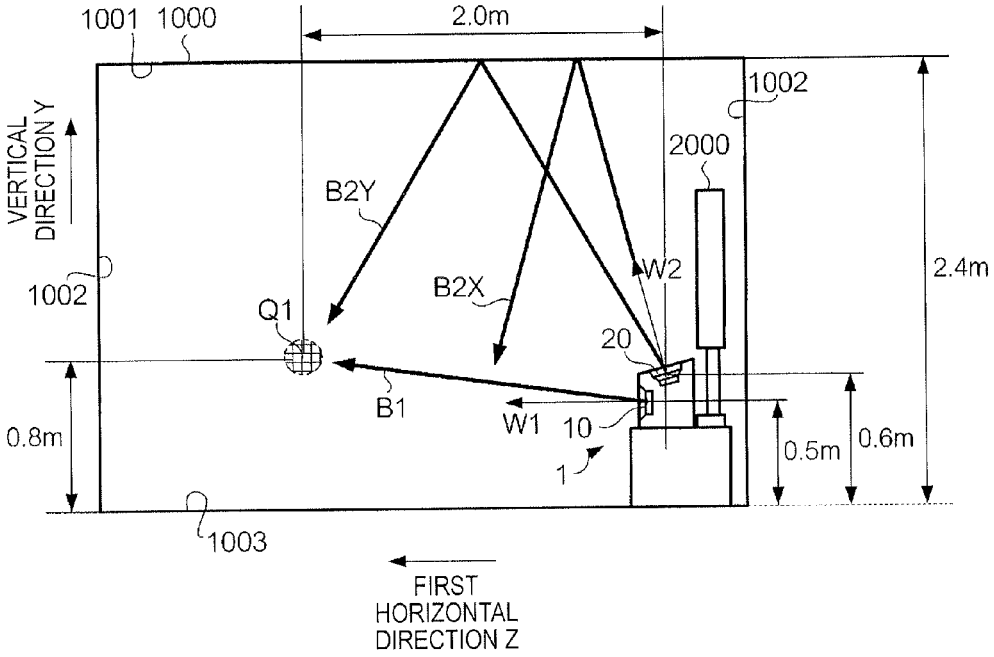
FIG. 6 shows example paths of surround beams that reach a sound receiving point.

FIG. 6 shows example paths of sound beams that travel from the speaker array device 1 installed in a room 1000 to a sound receiving point Q1. In FIG. 6, for convenience of description, the first speaker array 10 and the second speaker array 20 which are located inside the speaker array device 1 are drawn by solid lines. The room 1000 is a rectangular parallelepiped-shaped room that is formed by a ceiling 1001, four wall surfaces 1002, and a floor surface 1003. A TV receiver 2000 is installed beside one wall surface 1002. The ceiling 1001 has a height of 2.4 m as measured from the floor surface 1003. The floor surface 1003 is a horizontal surface. In FIG. 6, the speaker array device 1 is installed in such a manner that the first principal axis direction W1 is parallel with the floor surface 1003. That is, as in the state shown in FIG. 4, the speaker array device 1 is installed in such a manner that the first principal axis direction W1 is a horizontal direction (parallel with the first horizontal direction Z). The speaker array device 1 is placed on a TV stage together with the TV receiver 2000, as a result of which the first speaker array 10 and the second speaker array 20 are located at heights of 0.5 m and 0.6 m as measured from the floor surface 1003, respectively. The sound receiving point Q is located on the front side of the first speaker array 10 and is located at such a position that a sound beam B1 that is output from the first speaker array 10 reaches it directly. The term "to reach directly" means a sound (sound beam) that is output from the first speaker array 10 reaches the sound receiving point Q without being reflected or diffracted. In FIG. 6, the sound receiving point Q is located at a position that is distant from a position where the second speaker array 20 outputs a sound beam B2 by 2.0 m in the first horizontal direction Z and has a height of 0.8 m as measured from the floor surface 1003.

In the same manner as shown in FIG. 4, the second speaker array 20 outputs a sound beam B2 in the second principal axis direction W2 which is inclined from the vertical direction Y by 15° toward the sound receiving point Q1. The sound beam B2 which is output obliquely upward (somewhat deviated from the vertical direction Y) is reflected by the ceiling 1001 of the room 1000 and then travels obliquely downward (somewhat deviated from the vertical direction Y). In the second horizontal direction X, the sound beam B2 is a sound having certain directivity as a result of wavefront synthesis. On the other hand, in the first horizontal direction Z, the sound beam B2 is a free radiation sound like an ordinary sound that is output from a speaker unit. In other words, the second speaker array 20 is not arrayed in the first horizontal direction Z and hence cannot provide directivity in this direction. As such, a free radiation sound means a sound having free directivity that is not produced by a speaker array through wavefront synthesis. Comparison will be made of a position that is reached by a component B2*x*, traveling in the second principal axis direction W2, of the sound beam B2 and a position that is reached by a component B2*y* that travels in a direction that is inclined from the vertical direction Y by 30° toward the sound receiving point Q1 (i.e., a component, emitted in a direction that is inclined from the second principal axis direction W2 by 15°, of the sound beam B2). The component B2*x* is reflected by the ceiling 1001 and then reaches the height of the sound receiving point Q1 at a position that is spaced from the second speaker units 200 by about 0.9 m in the first horizontal direction Z. Likewise, the component B2*y* reaches the height of the sound receiving point Q1 at a position that is spaced from the second speaker units 200 by about 2.0 m. At the sound receiving point Q1, the component B2*y* has such a volume that a listener can hear it. That is, the sound beam B2 is output so that the free radiation component B2*y* reaches the sound receiving point Q1. The term "to reach the sound receiving point" means that a sound having at least such a volume that a listener can hear it substantially reaches the sound receiving point.

Figure 7:
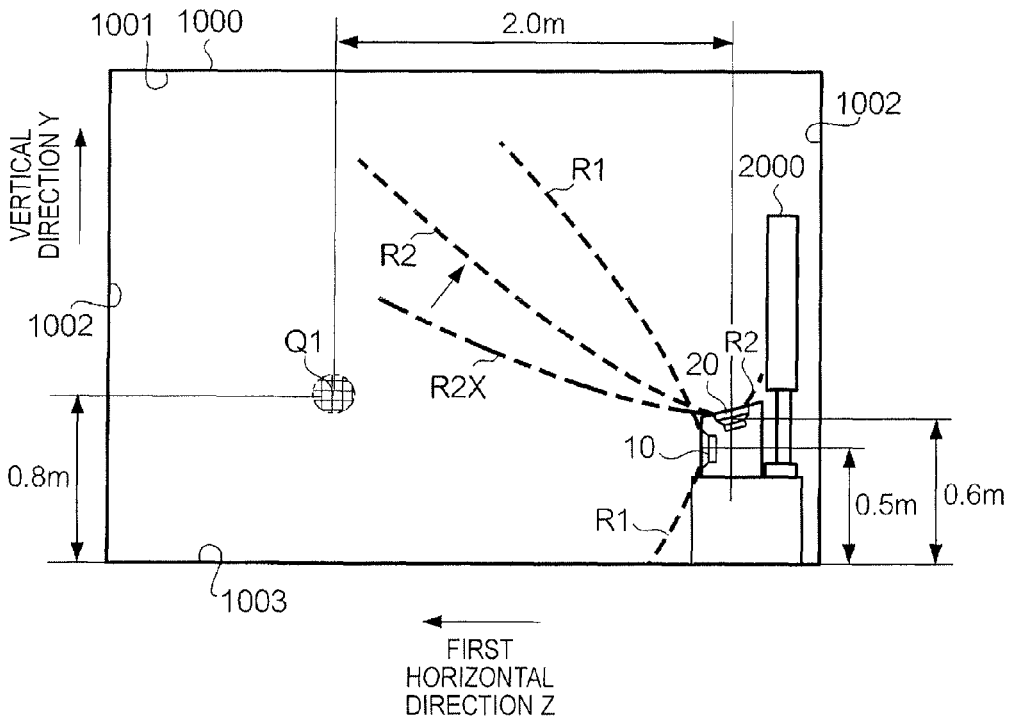
FIG. 7 shows example reachable ranges of sound beams.

In the example of FIG. 6, on the other hand, the sound beam B2 does not likely reach the sound receiving point Q1. FIG. 7 shows example reachable ranges of sound beams that are output from the speaker array device 1. In FIG. 7, boundaries R1 and R2 of meaningfully reachable ranges of sound beams B1 and B2 are indicated by broken lines, respectively. The term "meaningfully reachable" means that a sound beam reaches with such a large volume that it is heard as a first sound coming from its correct direction overcoming preceding sounds coming from other directions and other sounds. In the example of FIG. 7, the sound receiving point Q1 is included in the range R1, which means that the sound beam B1 reaches the sound receiving point Q1 meaningfully. On the other hand, as for the second speaker array 20, a recess portion 610 is formed in front of each second speaker unit 200. Because of the presence of the recess portions 610, the vibration plates that were described with reference to FIG. 4 are not seen when the second speaker unit 200 is seen from the sound receiving point Q1. Symbol R2*x* denotes a boundary in a case that the recess portions 610 are not formed and each second speaker units 200 is provided in such a manner that the wider-radius end of its vibration plate is located in the plane containing the surface 62 shown in FIG. 4. The boundary R2 defines a narrower range than the boundary R2*x* because the recess portions 610 decrease the radiation range of the sound beam B2.

Furthermore, the second speaker units 200 are disposed in such a manner that their front surfaces are directed to the direction that is more deviated from the direction of the sound receiving point Q1 than the direction to which the first speaker units 100 are directed. As a result, the sound receiving point Q1 is not included in the range denoted by R2. That is, the sound beam B2 does not reach the sound receiving point Q1 directly, that is, without being diffracted. If the speaker units were arranged in such a manner as to allow a radiated sound beam B2 to reach the sound receiving point Q1 directly, that is, without being diffracted, a sound that reaches the sound receiving point Q1 directly (hereinafter referred to as a direct sound) would travel along a path having a shorter distance to the sound receiving point Q1 than a sound that reaches the sound receiving point Q1 after being reflected by the ceiling 1001 (hereinafter referred to as a reflection sound; see FIG. 6) and hence the former would be heard earlier than the latter though they are the same sound. Therefore, at the sound receiving point Q1, the listener would feel an orientation position in the direction of the speaker units because of the precedence effect. In contrast, the speaker array device 1 according to the embodiment can prevent the phenomenon that the listener feels an orientation position in the direction of the speaker units because only reflection sounds reach the sound receiving point Q1 (or the listener tends to feel an orientation position in a direction of the ceiling because the sound volume of reflection sounds is larger than that of a direct sound by more than a prescribed amount).

Figure 8:
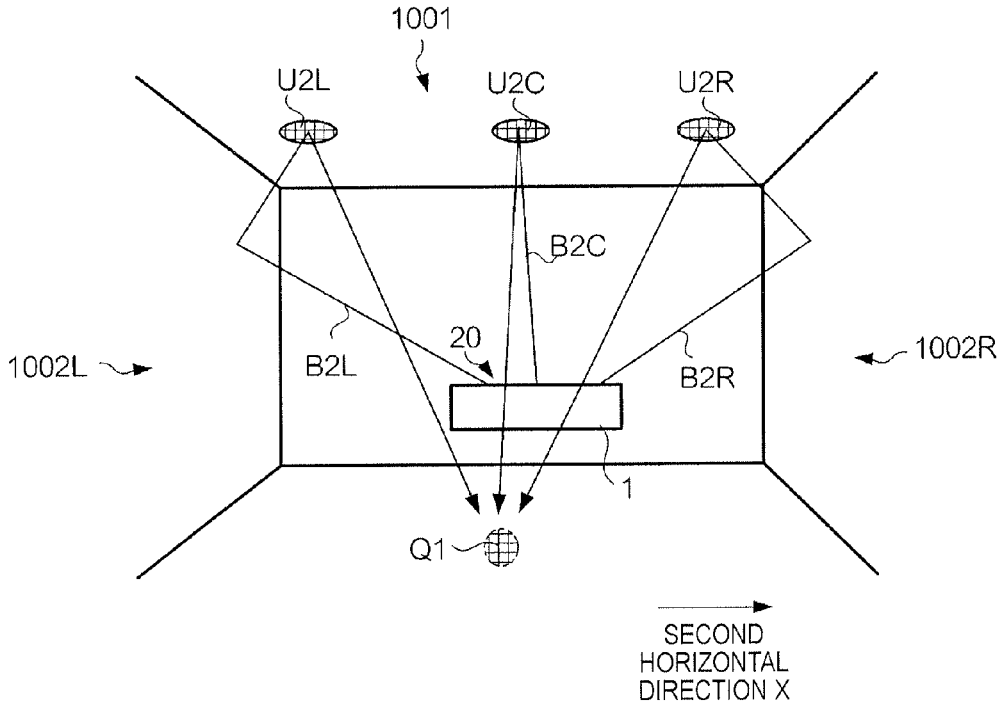
FIG. 8 shows example paths of a sound beam in which the speaker array device is seen from the front side.

FIG. 8 shows example paths of a sound beam B2 in which the speaker array device 1 seen from the front side. The sound beam B2 consists of sounds that are directed to plural directions in terms of a relationship with the second horizontal direction X. More specifically, the speaker array device 1 outputs a sound beam B2L which is first reflected by the left wall surface 1002L (as viewed from the sound receiving point Q1), a sound beam B2R which is first reflected by the right wall surface 1002R, and a central sound beam B2C which is not reflected by any wall surface. The sound beams are all output from the second speaker array 20, reflected by the reflection surfaces U2L, U2R, and U2C, respectively, and reaches the sound receiving point Q1. In this manner, the speaker array device 1 can produce virtual speakers at different positions in the second horizontal direction X also on the side of the ceiling 1001 as viewed from the sound receiving point Q1.

Figure 9:
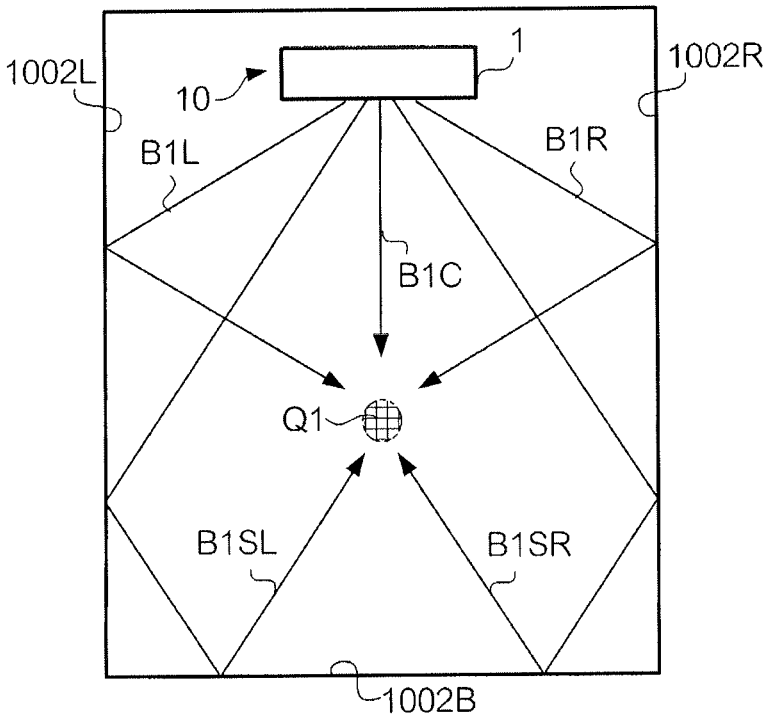
FIG. 9 shows example paths of a sound beam in which the speaker array device is seen from the ceiling side.

FIG. 9 shows example paths of a sound beam B1 in which the speaker array device 1 is seen from the ceiling side. The first speaker array 10 outputs a sound beam 131C which travels straightly toward the sound receiving point Q1 on the basis of an audio signal of the C channel. The first speaker array 10 also outputs sound beams B1L and B1R which travel toward the sound receiving point Q1 after being reflected by the wall surfaces 1002L and 1002R on the basis of audio signals of the L channel and the R channel, respectively. Furthermore, the first speaker array 10 outputs a sound beam B1SL which travels toward the sound receiving point Q1 after being reflected by the wall surface 1002L and the wall surface 1002B located behind the sound receiving point Q1 on the basis of an audio signal of the SL channel, and outputs a sound beam B1SR which travels toward the sound receiving point Q1 after being reflected by the wall surfaces 1002 and 1002B on the basis of an audio signal of the SR channel. In this manner, the speaker array device 1 forms five different virtual speakers arranged in the horizontal direction when viewed from the sound receiving point Q1 using a sound beam B1 which is output from the first speaker array 10.

Among the sound beams that are output in the above-described manner, the sound beam B1 reaches the first speaker array 10 by traveling in the horizontal direction from the position of the speaker array device 1 and the sound beam B2 reaches the first speaker array 10 by traveling downward from the ceiling 1001. As described above, the sound beams B1 and B2 are output on the basis of audio signals that have been delayed by the delay unit 340 according to the difference between the distances from the respective speaker arrays to the speaker array device 1. Therefore, portions, representing the same audio signal portion, of the sound beams reach the sound receiving point Q1 approximately at the same time. While the listener is listening to the sounds of the sound beams at the sound receiving point Q1, these portions of the sound beams come from the two directions, whereby the listener feel a sound image that is oriented in a direction that is interposed between the two directions. A virtual image speaker (virtual sound_image) also called a phantom sound source is thus formed.

Figure 10:
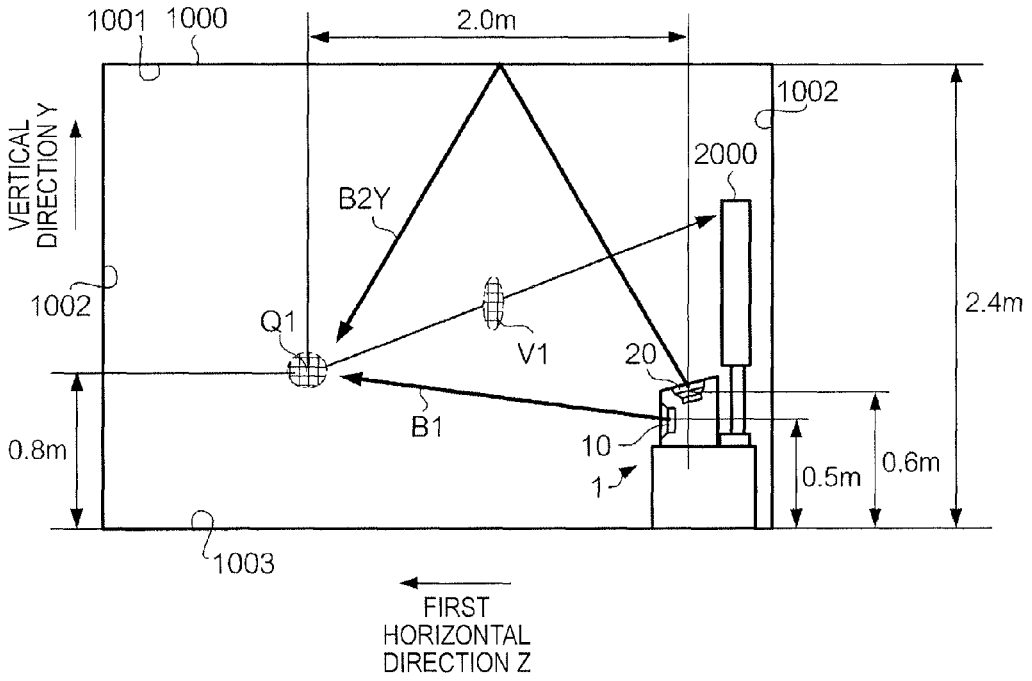
FIG. 10 shows the position of a virtual image speaker that is formed with a sound receiving point.

FIG. 10 shows the position of a virtual image speaker that is formed with the sound receiving point Q1. FIG. 10 shows sound beams B1C and B2C that are output from the first speaker array 10 and the second speaker array 20, respectively, to the center in the second horizontal direction X. The sound beam 131C is output on the basis of an audio signal obtained by delaying an audio signal of the sound beam B2C so that the sound of a portion of the sound beam B1C will seem the same as that of a portion of the sound beam B2C that will reach the sound receiving point Q1 at the same time as the former. In the example of FIG. 10, for the sound receiving point Q1, a virtual speaker V1 is formed in a direction that is directed to over the TV receiver 2000 among directions that are interposed between the incoming directions of the sound beams B1C and B2C. In this manner, the speaker array device 1 can form a virtual image speaker in a direction that is spaced in the vertical direction from the direction from the sound receiving point Q1 to the speaker array device 1.

As described above, the speaker array device 1 can form a virtual speaker on the ceiling while outputting such sound beams that the angle formed by the direction of a sound beam emitted from the second speaker array 20 and the second horizontal direction X can be adjusted because the front surface of the second speaker array 20 in which the plural second speaker units are arranged in the second horizontal direction X is directed obliquely upward (somewhat deviated from the vertical direction Y). To cause a reflection sound from the ceiling 1001 to reach the sound receiving point Q1 which is distant in the first horizontal direction Z, the speaker array device 1 utilizes the free radiation directivity of a second sound beam B2 traveling in the first horizontal direction Z which is different from the second horizontal direction X in which the second speaker units are arranged. This makes it unnecessary to arrange the second speaker units in the first horizontal direction Z or the vertical direction Y. If a speaker array were provided in which speaker units are arranged in the first horizontal direction Z to cause a reflection sound from the ceiling 1001 to reach the sound receiving point Q1, it would be necessary to arrange speaker units also in the second horizontal direction X to output a sound that is directed to the second horizontal direction X. The speaker array device 1 can make the number of second speaker units smaller and can be made smaller in size than a speaker array device that is constructed in the above-described manner.

In the speaker array device 1, the second speaker array 20 outputs a sound beams in a frequency range that is higher than a prescribed frequency. High-frequency sounds have a property that they are higher in directivity, that is, less apt to be diffracted, than low-frequency sounds. Therefore, in the speaker array device 1, a direct sound can be made less reachable to the sound receiving point Q1 than in a case that the second speaker array 20 outputs a sound beam that includes a sound in a frequency range than is lower than the prescribed frequency. In other words, in the speaker array device 1, the range that includes the sound receiving point Q1 and in which a listener can hear the sound of a sound beam B2 without being obstructed by a direct sound from the second speaker array 20 can be made wider toward the self device than in the above case.

[Modifications]

The above-described embodiment is just an example of practice of the invention, and various applications and modifications described below are possible. And the embodiment can be combined with another if necessary.

(Modification 1)

Although in the above embodiment the first speaker array 10 and the second speaker array 20 are provided in the same cabinet 6, they may be provided in different cabinets.

Figure 11:
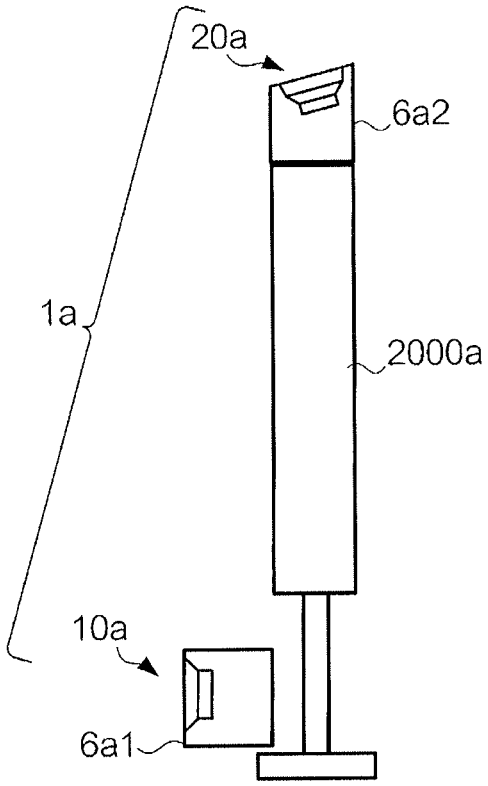
FIG. 11 shows the configuration of a speaker array device according to a modification.

FIG. 11 shows the configuration of a speaker array device 1*a* according to this modification. The speaker array device 1*a* has cabinets 6*a*1 and 6*a*2, and a first speaker array 10*a* and a second speaker array 20*a* are provided in the cabinets 6*a*1 and 6*a*2, respectively. For example, where the cabinet 6*a*2 is disposed on top of a TV receiver 2000*a*, the reachable range of a direct sound coming from the second speaker array 20*a* is shifted toward the ceiling 1001 from a case that the second speaker array 20 is disposed at a position that is lower than the second speaker array 20*a*. As a result, the use of the speaker array device 1*a* can make a direct sound less reachable to the sound receiving point Q1 than in the case where only one cabinet is used.

(Modification 2)

Although in the above embodiment the angle θ4 by which the second principal axis direction W2 is inclined from the vertical direction Y toward the sound receiving point Q1 is set at 15° (see FIG. 4), the invention is not limited to such a case. The angle θ4 may be 30° or 0°. Where θ4 is equal to 0°, the second principal axis direction W2 coincides with the vertical direction Y and the second speaker units 200 is directed right upward (to the vertical direction). In short, θ4 may be any angle as long as the second speaker array 20 is installed in such a manner that the front surfaces of the second speaker units 200 are directed to (i.e., the normal to the surface 66 (second surface) shown in FIG. 4 is in) such a direction that the second principal axis direction W2 is so distant from the direction from the second speaker units 200 to the sound receiving point Q1 that a direct sound does not reach (or almost no direct sound reaches) the sound receiving point Q1 or that, even if a direct sound reaches the sound receiving point Q1, a reflection sound reaches the sound receiving point Q1 with a sufficiently larger volume than a direct sound. The term "a reflection sound having a sufficiently larger volume than a direct sound" means that the ratio of the sound pressure (energy) of the reflection sound to that of the direct sound is larger than or equal to a prescribed value. If the volume of a reflection sound is sufficiently larger than that of a direct sound, the direct sound is masked by the reflection sound and the listener would feel as if not to hear the direct sound though it reaches him or her actually or the direct sound had a lower volume than an actual value.

The direction to which the front surfaces of the second speaker units 200 are directed may be inclined toward the side opposite to the sound receiving point Q1 rather than toward the sound receiving point Q1.

Figure 12:
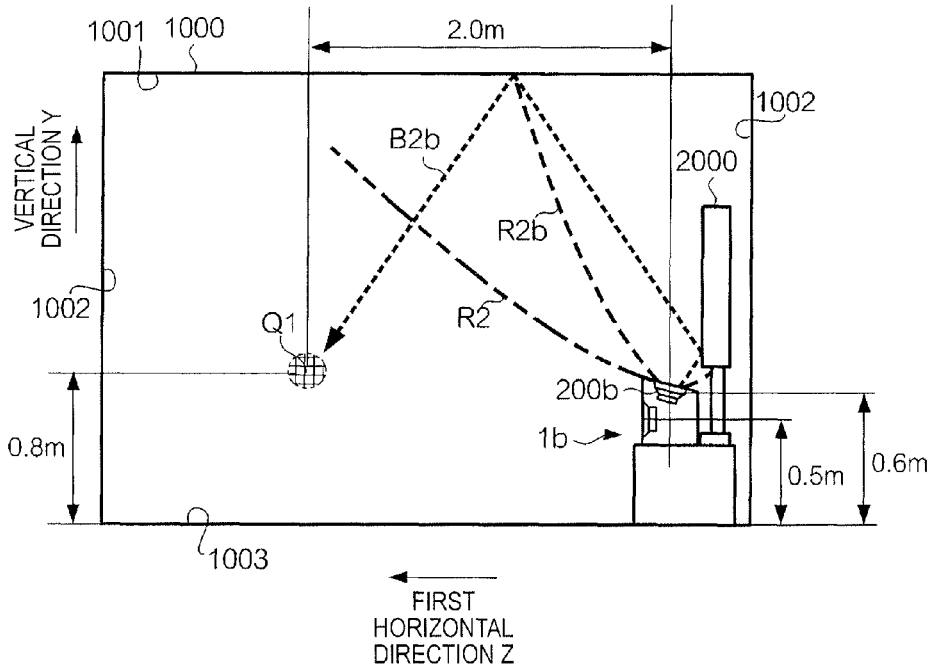
FIG. 12 shows the configuration of a speaker array device according to a modification.

FIG. 12 shows the configuration of a speaker array device 1*b* according to this modification. The speaker array device 1*b* has second speaker units 200*b* whose front surfaces are directed to a direction that is inclined from the vertical direction Y toward the side opposite to the sound receiving point Q1. In this case, a sound beam B2*b* that is output from the second speaker units 200*b* reaches the sound receiving point Q1 after being reflected by the TV receiver 2000 and then by the ceiling 1001. In the speaker array device 1*b*, the second speaker units 200*b* are disposed at such positions as not to be seen from the sound receiving point Q1. In this case, a meaningful direct sound emitted from the second speaker units 200*b* reaches a range that is defined by a boundary R2*b*. In FIG. 12, the boundary R2 that is shown in FIG. 7 is drawn by a two-dot chain line. As shown in FIG. 12, the boundary moved from R2 to R2*b* in such a direction as to go away from the sound receiving point Q1 because the direction to which the front surfaces of the second speaker units 200 were directed was made more distant from the sound receiving point Q1. As a result, in the speaker array device 1*b*, a direct sound can be made less reachable to the sound receiving point Q1 than in the case where the direction to which the front surfaces of the second speaker units 200 are directed is inclined toward the sound receiving point Q1.

It is even desirable that the second speaker array is such as to output a sound beam that provides, at the sound receiving point Q1, a sound pressure ratio (mentioned above) of about 12 dB or larger. Where a direct sound reaches the sound receiving point Q1 earlier than a reflection sound (by about 30 ms), a listener may feel as if to hear a sound coming only from the direction of the direct sound. If this phenomenon (what is called the Haas effect) occurs, a virtual speaker is not formed in a ceiling direction though it should be and a listener feels only a state that the speaker array device itself is emitting a sound. In this connection, if the above-mentioned sound pressure ratio is larger than or equal to 12 dB, the Haas effect is canceled out and a virtual speaker is formed by a reflection sound in an incoming direction of a direct sound. Thus, the speaker array device can form a virtual speaker using a reflection sound at a stable position.

(Modification 3)

Although in the above embodiment the radiation of a sound beam B2 to the side of the sound receiving point Q1 is suppressed by forming the recess portions 610 in the surface 62, the radiation may be suppressed by other methods. For example, it is possible to simply form holes in the surface 62 instead of forming the recess portions 610 and to dispose the second speaker units 200 at places that are located inside a cabinet (spaced from the plane containing the surface 62) and are not seen from the sound receiving point Q1. In this case, part of a sound beam B2 is interrupted by a surface located on the back side of the surface 62 and the degree of its radiation is suppressed.

For another example, a cabinet may be provided with a member that interrupts part of the path of a sound beam B2.

Figure 13:
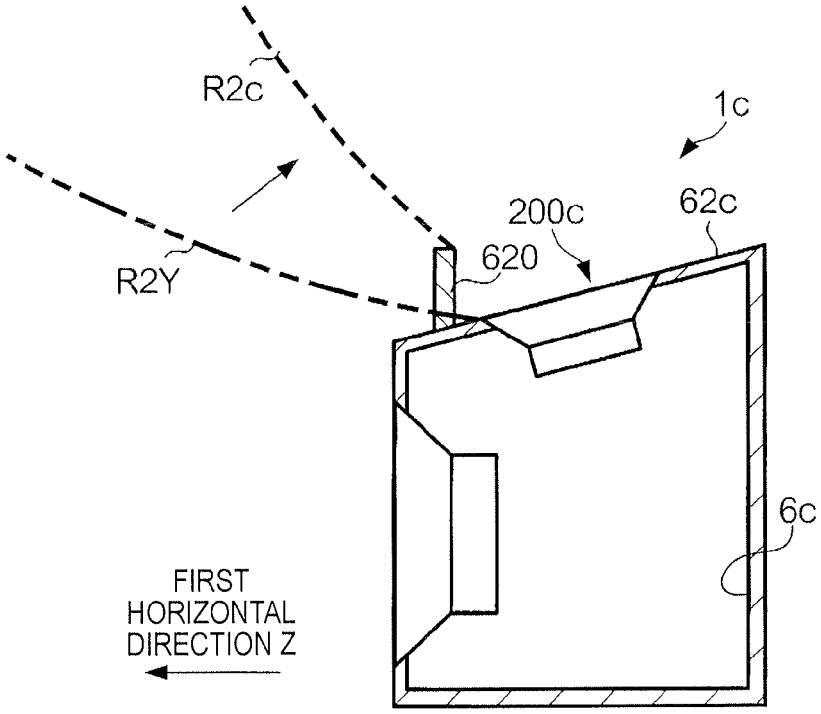
FIG. 13 is a sectional view of a speaker array device according to a modification.

FIG. 13 is a sectional view of a cabinet 6*c* of a speaker array device 1*c* according to this modification. In FIG. 13, as in FIG. 4, side views of speaker units are drawn. The cabinet 6*c* of the speaker array device 1*c* is different from the cabinet 6 in that a surface 2*c* is not formed with the recess portions 610 and the wider-radius ends of second speaker units 200*c* are located in the plane containing the surface 62*c*. In other words, the second speaker units 200 are arranged in the surface 62*c* (an example of the second surface). The surface 62*c* is provided with a shield plate 620 at a position that is closer to the sound receiving point Q1 than the second speaker units 200*c* are when the speaker array device 1*c* is installed as shown in FIG. 6. In the speaker array device 1*c*, when it is seen from the sound receiving point Q1, the vibration plates of the second speaker units 200*c* are located at such positions as not to be seen being shielded by the shield plate 620. The shield plate 620 interrupts that a portion, to be radiated to the first horizontal direction Z, of a sound beam that is output from the second speaker units 200*c*. A boundary R2*c* of a range to which a sound beam that is partially interrupted by the shield plate 620 reaches meaningfully and a boundary R2*y* of a case that the shield plate 620 is not provided are shown in FIG. 13. Since the shield plate 620 interrupts that portion of a sound beam which would otherwise be radiated to the first horizontal direction Z, as shown in FIG. 13 the range to which a direct sound emitted from the second speaker units 200 does not reach without being diffracted is widened. That is, the speaker array device 1*c* can cause a direct sound to less reachable to the sound receiving point Q1 than in the case where the shield plate 620 is not provided.

(Modification 4)

Although in the above embodiment a sound beam B2 in a frequency range that is higher than the prescribed frequency is output, the invention is not limited to such a case. In the speaker array device 1, a sound beam B2 in the same frequency range as audio signals supplied may be output without eliminating sound components in a lower frequency range than the prescribed frequency. In short, it suffices that the second speaker units 200 be disposed so that their front surfaces are directed to a direction in which the volume of a reflection sound becomes sufficiently larger than that of a direct sound.

(Modification 5)

Although in the above embodiment the first speaker units 100 are arranged in the second horizontal direction X, they may be arranged in a direction that is different from the second horizontal direction X. For example, the first speaker units 100 may be arranged in a direction that is oblique to the second horizontal direction X, and may be arranged in an arc shape or a V shape rather than a straight line. A straight line, an arc shape, and a V shape are example shapes that are formed by the arrangement of the first speaker units 100. Furthermore, the first speaker units 100 may be arranged in two or more rows. In any of those cases, it suffices that the first speaker units 100 be arranged in the surface 61 (first surface). As a result, the first speaker array 10 outputs a sound beam B1 (first sound) that is directed to a particular direction (first directivity direction) and is such that the angle formed by the particular direction and the longitudinal direction of a shape that is formed by the arrangement of the first speaker units 100 can be adjusted. The term "longitudinal direction" means the direction of the longer sidelines of a minimum rectangle that can enclose a shape formed by the arrangement.

Figure 14:
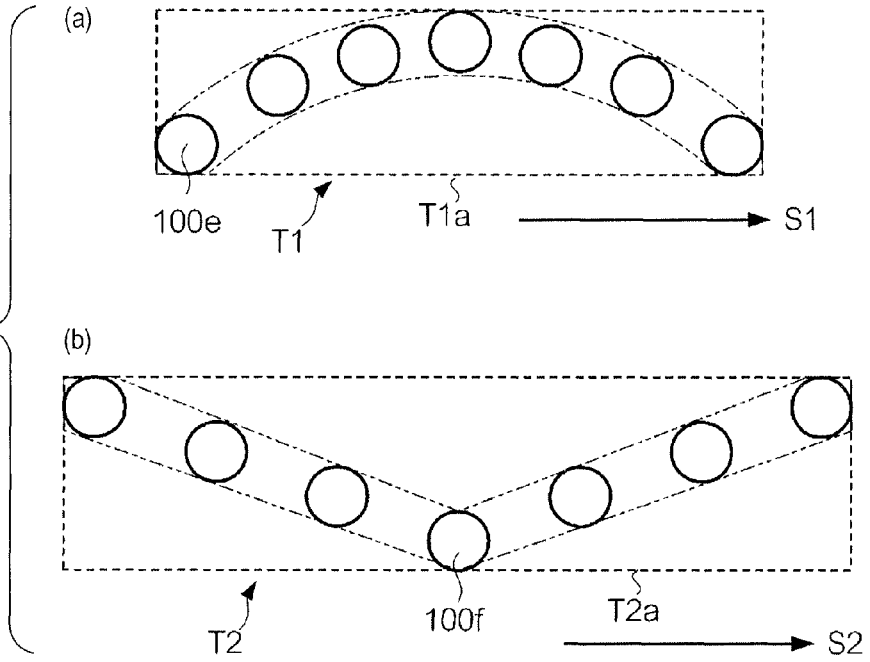
FIG. 14 shows example first speaker units according to this modification.

FIG. 14 shows example first speaker units according to this modification. FIG. 14 shows plural first speaker units 100*e* (FIG. 14(*a*)) and plural first speaker units 100*f* (FIG. 14(*b*)) as seen from the negative side of the first horizontal direction Z. The arrangement of the plural first speaker units 100*e* assumes an arc shape which is indicated by a two-dot chain line. A rectangle T1 is a minimum rectangle that can enclose this shape. In this case, the direction indicated by an arrow S1 which is parallel with the longer sidelines T1*a* of the rectangle T1 is the longitudinal direction. The arrangement of the plural first speaker units 100*f* assumes a V shape which is indicated by a two-dot chain line. A rectangle T2 is a minimum rectangle that can enclose this shape. In this case, the direction indicated by an arrow S2 which is parallel with the longer sidelines T2*a* of the rectangle T2 is the longitudinal direction. Each of these sets of first speaker units can output a sound beam (first sound) that is directed to a particular direction (first directivity direction) and is such that the angle formed by the particular direction and its longitudinal direction can be adjusted.

(Modification 6)

Although in the above embodiment the second speaker units 200 are arranged in the second horizontal direction X, they may be arranged in a direction that is different from the second horizontal direction X like the above-described first speaker units 100 according to the fifth modification. For example, the second speaker units 200 may be arranged in a direction that is oblique to the second horizontal direction X, and may be arranged in such a manner that the arrangement direction changes halfway. In other words, the second speaker units 200 need not always be arranged straightly. For example, the second speaker units 200 may be arranged in an arc shape or a V shape. In either case, it suffices that the second speaker units 200 be arranged in a single row in the surface 66 (second surface). As a result, the second speaker array 20 outputs a sound beam B2 (second sound) that is directed to a particular direction (second directivity direction) and is such that the angle formed by the particular direction and the longitudinal direction of a shape that is formed by the arrangement of the second speaker units 200 can be adjusted. It is desirable that the longitudinal direction of the second speaker array 20 be parallel with the above-described longitudinal direction of the first speaker array 10. Even if the longitudinal direction of the second speaker array 20 is not parallel with that of the first speaker array 10, satisfactory results are obtained as long as these longitudinal directions are not perpendicular to each other when viewed in the vertical direction Y. Also in this case, the speaker array device can make smaller the number of second speaker units and the dimensions than in the case where the second speaker units are arranged also in the first horizontal direction Z.

Although the second speaker array has the plural second speaker units arranged in a single row, part of the second speaker units may be arranged in plural rows or arranged in the first horizontal direction Z. Even in this case, the portion where plural second speaker units are arranged in a single row can serve to reduce the number of second speaker units and the dimensions as in the above-described case.

(Modification 7)

Although in the above embodiment the speaker array device 1 is installed on top of the TV stage which is installed in the rectangular parallelepiped room 1000, the invention is not limited to such a case. The speaker array device 1 may be installed at another position in the room 1000 or in another room having a shape other than a rectangular parallelepiped. The speaker array device 1 may be installed in an outdoor space which has reflection surfaces for reflecting sound beams that are output from the speaker array device 1 and has a reflection surface that is located at a position higher than a sound receiving point and faces the bottom side in the vertical direction. By causing sound beams to be reflected by those reflection surfaces, the speaker array device 1 can form plural virtual speakers that are located above a listener at different positions in the second horizontal direction.

(Modification 8)

Although in the above embodiment the second speaker units 200 of the second speaker array 20 are exposed to the outside of the cabinet 6, they may be provided so as not to be exposed to the outside of the cabinet.

Figure 15:
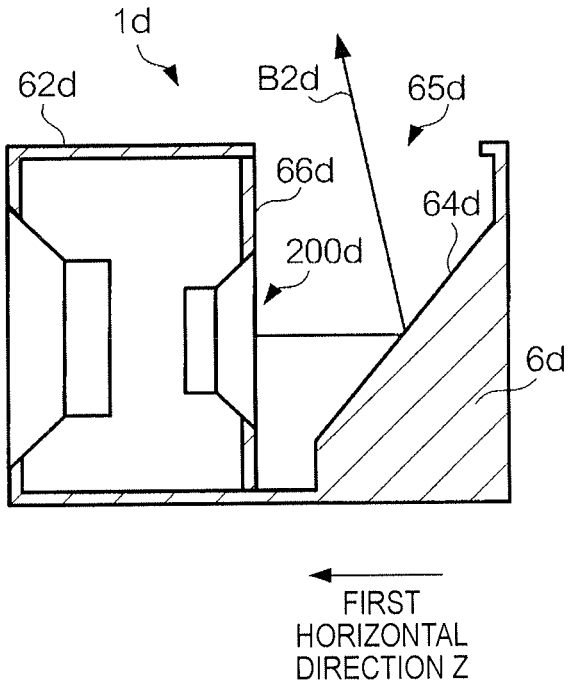
FIG. 15 is a sectional view of a speaker array device according to a modification.

FIG. 15 is a sectional view of a cabinet 6*d* of a speaker array device 1*d* according to this modification. In FIG. 15, as in FIG. 4, side views of speaker units are drawn. The speaker array device 1 has second speaker units 200*d* which are arranged in an inside surface 66*d* (an example of the second surface) of the cabinet 6*d*. The front surfaces of the second speaker units 200*d* are opposed to an inside reflection surface 64*d* of the cabinet 6*d*. A surface 62*d*, directed upward in the vertical direction, of the cabinet 6*d* is formed with an opening 65*d* which is adjacent to the outside. A sound beam B2*d* that is output from the second speaker units 200 is reflected by the reflection surface 64*d*, passes through the opening 65*d*, is reflected by the ceiling 1001, and the reaches the sound receiving point Q1. Also in the speaker array device 1*d*, the vibration plates of the second speaker units 200*d* are disposed at such positions as not to be seen from the sound receiving point Q1. In this case, a direct sound can be made less reachable to the sound receiving point Q1 because the opening 65*d* narrows the range of radiation of a sound beam B2*d* in the first horizontal direction Z.

(Modification 9)

Although in the above embodiment sounds of respective channels are output so as to travel along particular paths, respectively, the paths may be varied dynamically according to according to the contents of sounds of the respective channels. For example, the speaker array device 1 may compare L-channel and R-channel audio signals contained in horizontal signals and include a high-correlation component of those signals in a ceiling-C channel signal of ceiling signals. In this case, the volumes of sound beams to be output so as to travel along the L-channel and R-channel paths may be reduced. With this measure, in the speaker array device 1 according to this modification, in the case where the sound of video is output that is expressed in such a manner that the sound whose sound source to be moved in the vertical direction is switched from the L channel to the R channel (or in the opposite direction), sounds can reach a listener from virtual speakers that are formed in such direction as to conform to the sound source position more properly.

(Modification 10)

Although in the above embodiment input signals Sin represent 5.1ch audio signals including signals of the five channels, that is, the R, L, C, SR, and SL signals, the invention is not limited to such a case. For example, input signals Sin may represent audio signals of more channels such as 7.1ch or 9.1ch audio signals or audio signals of less channels such as 3.1ch audio signals. Audio signals may contain a height-channel signal representing a vertical direction signal. In this case, the signal processing unit 320 supplies the bus management unit 330 with horizontal signals containing a height-channel signal and horizontal signals not containing a height-channel signal. With this measure, a sound of the height-channel signal is output from the second speaker array 20 and a virtual speaker to output this sound is formed in the ceiling direction.

Although in the above embodiment the direction in which the virtual image speaker V1 is formed is determined as shown in FIG. 10, this direction may be changed in the speaker array device 1. This direction is changed in the vertical direction Y when the sound volume difference between sound beams B1C and B2C. This direction is also changed by changing the frequency range of a sound beam B2C. In the speaker array device 1 according to this modification, first a user determines a direction in which to form a virtual image speaker by manipulating the manipulation unit 4 and then the manipulation unit 4 outputs information indicating the determined direction to the control unit 2. In this case, the manipulation unit 4 functions as a determining section as defined in the invention. Then the control unit 2 adjusts such parameters as the volumes or the boundary frequency of a sound beam B1 (first sound) and a sound beam B2 (second sound) according to the information that is output from the manipulation unit 4. More specifically, the control unit 2 adjusts these parameters that are read from the storage unit 3 according to the information that is output from the manipulation unit 4. If the adjusted parameters are the volumes, the control unit 2 supplies the adjusted parameters to the signal processing unit 320. If the adjusted parameter is the boundary frequency, the control unit 2 supplies the adjusted parameter to the bus management unit 330. The first speaker array 10 and the second speaker array 20 output sound beams on the basis of signals obtained by performing the other pieces of processing shown in FIG. 5 on audio signals that are output from the signal processing unit 320 or the bus management unit 330. The sound beams are such as to form a virtual image speaker in the direction that conforms to the information that is output from the manipulation unit 4 and reflected in the parameters. The virtual image speaker forming direction as viewed from the sound receiving point Q1 is adjusted in this manner. In this case, the control unit 2 functions as an adjustor as defined in the invention.

Although the present invention has been described in detail by referring to the particular embodiment, it is apparent to those skilled in the art that various changes and modifications are possible without departing from the spirit and scope of the invention.

The present application is based on Japanese Patent Application No. 2011-146720 filed on Jun. 30, 2011, the disclosure of which is incorporated herein by reference.

INDUSTRIAL APPLICABILITY

The invention can realize a small speaker array device which can form plural virtual speakers in each of the horizontal direction and the ceiling direction.

DESCRIPTION OF REFERENCE NUMERALS AND SIGNS

1 . . . Speaker array device; 2 . . . Control unit; 3 . . . Storage unit; 4 . . . Manipulation unit; 5 . . . Interface; 6 . . . Cabinet; 10 . . . First speaker array; 20 . . . Second speaker array; 30 . . . Audio processing unit; 40 . . . Subwoofer; 100 . . . First speaker unit; 200 . . . Second speaker unit; 310 . . . Decoder; 320 . . . Signal processing unit; 330 . . . Bus management unit; 340 . . . Delay unit; 350 . . . Ceiling beam generation unit; 360 . . . Horizontal beam generation unit; 1000 . . . Room; 1001 . . . Ceiling; 1002 . . . Wall surface; 1003 . . . Floor surface

The invention claimed is:

1. A speaker array device comprising:

a first speaker array configured to have plural first speaker units arranged in a first surface and output a first sound that is directed to a particular first direction from the plural first speaker units such that an angle of the first direction with respect to an arrangement direction of the plural first speaker units is adjustable; and a second speaker array configured to have plural second speaker units arranged in a second surface that is different from the first surface and output a second sound that is directed to a particular second direction from the plural second speaker units such that an angle of the second direction with respect to an arrangement direction of the plural second speaker units is adjustable, wherein when the second speaker array is installed together with the first speaker array in a room having a ceiling which functions as a sound reflection surface, the second speaker array is installed in such a manner that a normal direction to the second surface is match with a direction in which the second sound emitted from the second speaker array reaches, only indirectly, through reflection or diffraction, a sound receiving point or a direction in which the second sound reaches the sound receiving point such that a sound pressure ratio of a sound pressure of the second sound that reaches the sound receiving point after being reflected by the ceiling to a sound pressure of the second sound that reaches the sound receiving point directly is larger than or equal to a prescribed value, the sound receiving point being located in a normal direction to the first surface and being set as a position for listening to the first sound.

2. The speaker array device according to claim 1, wherein the second speaker array outputs the second sound based on an audio signal supplied to the second speaker array;

the speaker array device is configured to further have a delay section which delays the audio signal according a difference between a length of a path of the second sound from the second speaker array to the sound receiving point and a length of a path of the first sound from the first speaker array to the sound receiving point, wherein the first speaker array outputs the first sound based on a delayed audio signal generated by the delay section.

3. The speaker array device according to claim 2, further comprising:

an attenuator configured to attenuate a component of the audio signal in part, lower than or equal to a prescribed boundary frequency, of a frequency range of a sound represented by the audio signal, wherein the second speaker array outputs the second sound based on an attenuated audio signal generated by the attenuator; and wherein the first speaker array outputs the first sound based on an audio signal, not attenuated by the attenuator, of the component of the audio signal in part, lower than or equal to the prescribed boundary frequency, of the frequency range of the sound represented by the audio signal.

4. The speaker array device according to claim 2, further comprising:

a determining section configured to determine a direction to form a virtual sound image for the sound receiving point using the first sound and the second sound; and an adjustor configured to adjust respective volumes of the first sound and the second sound, the boundary frequency, or a time by which the delay section delays the audio signal, according to the direction determined by the determining section, wherein the first speaker array outputs the first sound based on an audio signal generated by processing that uses a result of the adjustment by the adjustor; and wherein the second speaker array outputs the second sound based on an audio signal generated by processing that uses a result of the adjustment by the adjustor.

5. The speaker array device according to claim 1, wherein all of vibration plates of the plural second speaker units are disposed at positions so as not to be seen from the sound receiving point when the second speaker array is installed in the room.

* * * * *